United States Patent [19]

Teichmann

[11] Patent Number: 4,819,143

[45] Date of Patent: Apr. 4, 1989

[54] PROJECTOR LAMP

[75] Inventor: Clemens Teichmann, Frankfurt am Main, Fed. Rep. of Germany

[73] Assignee: Atelier für Kunst und Technik GmbH, Frankfurt am Main, Fed. Rep. of Germany

[21] Appl. No.: 83,650

[22] Filed: Aug. 7, 1987

[30] Foreign Application Priority Data

Aug. 16, 1986 [DE] Fed. Rep. of Germany ... 8621953[U]

[51] Int. Cl.[4] ..... F21S 1/12

[52] U.S. Cl. ..... 362/282; 362/287; 362/296; 362/418

[58] Field of Search ..... 362/270, 277, 282, 287, 362/296, 413, 419, 431, 347, 418

[56] References Cited

U.S. PATENT DOCUMENTS

| | | | |
|---|---|---|---|
| 1,476,149 | 12/1923 | Cohen | 362/282 |
| 1,751,011 | 3/1930 | Martin, Jr. | 362/282 |
| 1,798,083 | 3/1931 | Halbach | 362/282 |
| 2,379,933 | 7/1945 | Schwarzmayr | 362/282 |
| 2,488,146 | 11/1949 | Steinhaus | 362/282 X |
| 2,522,189 | 9/1950 | Morrow | 343/721 X |
| 3,459,935 | 8/1969 | Bruner | 362/270 |
| 4,388,678 | 6/1983 | Turner | 362/296 X |

FOREIGN PATENT DOCUMENTS

| | | | |
|---|---|---|---|
| 138558 | 2/1920 | United Kingdom | 362/282 |

*Primary Examiner*—Ira S. Lazarus
*Assistant Examiner*—Richard R. Cole
*Attorney, Agent, or Firm*—Toren, McGeady & Associates

[57] ABSTRACT

A radiator lamp having at least one adjustable light beam. The lamp includes a radiator light and a mirror mounted in alignment with and adjustable relative to the radiator light. A swivel bearing for swiveling the mirror and a telescopically extendable and retractable rod are provided, wherein the swivel bearing is connected to the free end of the rod. Adjustment of the light beam of the lamp is easily possible even when the lamp is mounted at locations which are difficult to reach.

14 Claims, 3 Drawing Sheets

PROJECTOR LAMP

BACKGROUND OF THE INVENTION

1. Field of the Invention

The present invention relates to a projector lamp having an adjustable light beam.

2. Description of the Prior Art

In order to be able to swing or adjust the light beam of a light source, this light source is generally mounted so as to be swivelable with respect to a wall, a ceiling or a floor. This type of mounting has the disadvantage that a frequent swiveling of the lamp causes the insulation of the supply cable to the lamp to be destroyed by chaffing at particularly endangered points or the cable itself may break, particularly at a point which is subjected to heat.

Previously known lamps have the further disadvantage that, if these lamps are mounted on inaccessible locations, e.g., at a ceiling, a special elevating platform or a ladder must be used for carrying out an adjustment of the lamp.

It is, therefore, the primary object of the present invention to provide a projector lamp with an adjustable light beam of the type described above, in which the light source as well as the current supply can be securely installed and in which, moreover, the adjustment of the light beam is easily possible even when the lamp is mounted at locations which are difficult to reach.

SUMMARY OF THE INVENTION

In accordance with the present invention, this object is met by a projector lamp which includes a mirror which is arranged in alignment with a projector light and is adjustable relative to this projector light.

The adjustment of the mirror does not interfere with the current supplied to the projector light. In addition, the mirror can be arranged at locations which are more easily accessible than the light as the light source.

In accordance with a first embodiment of the present invention, the mirror can be swiveled about a swiveling axis whose swivel bearing is rigidly connected to the free end of a rod which can be telescopically extended and retracted. This makes it possible to increase the projection range of the light beam reflected by the mirror, without having to make adjustments in the projector light itself or in the current supply to the light.

The base of the telescoping rod and a support member for the projector light are advantageously mounted on a common support rod.

The components mounted at the upper end of the support rod are a cover plate, a support member for a guide tube of the telescoping rod and a support member for the projector light. As a result, it is easily possible to move the mirror downwardly for the adjustment of the mirror.

In accordance with another embodiment of the present invention, the adjustability of the mirror is improved by making the telescoping rod an extendable member which is automatically controlled by means of a lifting motor. The lifting motor is fastened to the support rod as the basis of the telescoping rod. Accordingly, the mirror can be moved upwardly and downwardly relative to the projector light by means of an electric motor.

A further improvement of the adjustability is obtained by connecting the support rod to the drive shaft of a gear motor. Thus, the use of an electric gear motor makes possible the adjustment of the mirror about an axis of rotation.

The gear motor is arranged on a stand within a base. The support rod extends through an eccentrically arranged opening formed in a cover of the base.

An upper plate and a lower plate are eccentrically mounted on the support rod. A shielding tube is mounted so as to surround the upper and lower plates.

The upper plate and the lower plate may have an oval or drop-like shape. The shielding tube may be made of sheet metal the longitudinal ends of which may be wound up into a rolled-up portion.

The mirror may be arranged at the end of a rotatably mounted lever, wherein the end of the lever is in operative connection with an eccentric member driven by a swiveling motor.

By means of the three electric adjusting possibilities described above, the light beam can be directed in a simple manner at any desired point. Usually, the mirror according to the present invention can be adjusted relative to the light beam only by a limited angle of less than 90°. If a greater range is to be reached by the mirror, another mirror is used to make it possible to swivel the above-described mirror by more than 90°.

In accordance with another feature of the present invention, the swivel bearing for the lever and the swiveling motor are mounted on a plate which is mounted on the free end of the telescoping rod by means of a round rod attachment.

In order to reduce the weight load acting on the telescoping rod, the mirror may have a central opening which is closed by means of a pin. Special light effects can be obtained if the pin is made of a fluorescent acrylic glass.

In accordance with a further development of the invention, a projection lamp with a plurality of projection lights and a plurality of adjustable mirrors can be provided. The projection lamp described above can easily be modified to obtain a lamp in accordance with this further development.

A swivel limit switch may be provided in the circuit of the gear motor. The support rod may be in operative connection with an actuating member for the swivel limit switch.

The switches in the circuits of the gear motor, of the lifting motor for the automatic antenna and of the swiveling motor for the mirror and of the projection light may be components of a remote control unit arranged in the base. As a result, the light beam of the projection lamp can be easily adjusted by remote control.

In accordance with another feature of the present invention, the projection lamp may automatically change its adjustment permanently with respect to swiveling the mirror, rotating the support rod and raising and lowering the telescoping rod.

The projection lamp according to the present invention may advantageously be used as a floor lamp, a stool lamp, a wall lamp or a ceiling lamp. It is easily possible to adapt the lamp according to the present invention to these uses.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
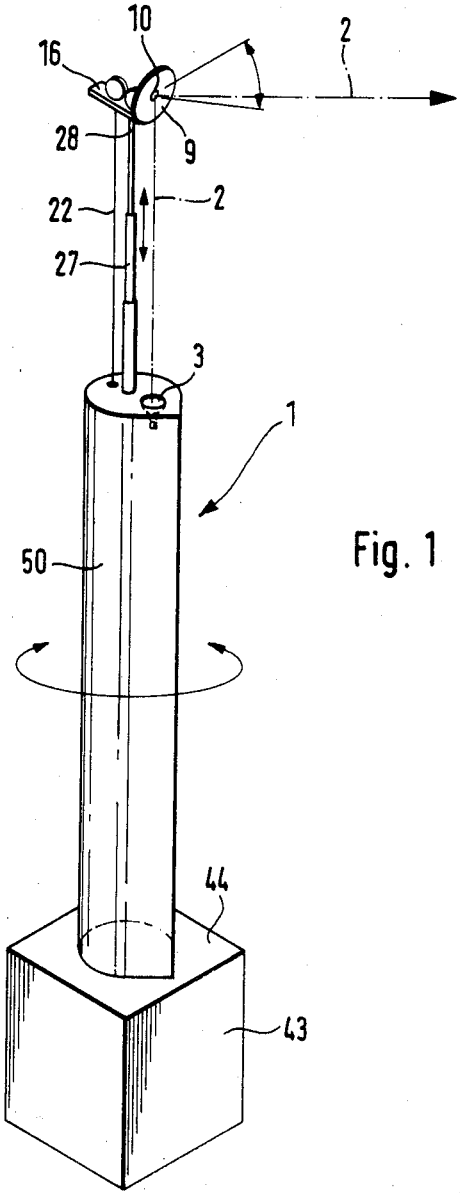
FIG. 1 is a schematic perspective view of the projection lamp according to the present invention.

FIG. 1 is a schematic general view of a projection lamp 1 in accordance with the present invention. A projection light 3 emits a light beam 2 which is reflected by a mirror 9. Mirror 9 can be swiveled as indicated by a double arrow.

Mirror 9 is swivelably mounted on a plate 16 which is attached to the free end 28 of an extendable and retractable rod 27. Rod 27 can be extended and retracted as indicated by the double arrow shown next to rod 27.

Extendable and retractable rod 27 extends out of a shielding tube 50. As illustrated in the drawing, projection light 3 is mounted at the upper end of tube 50. Shielding tube 50 can be rotated as indicated by a circular double arrow illustrated in FIG. 1 of the drawing.

Projection lamp 1 is mounted on a base 43. Base 43 has a cover 44. A support rod 33, not shown in FIG. 1, extends through cover 44, as shall be described in detail below.

As can be clearly seen from FIG. 1, the mirror can be adjusted upwardly and downwardly and can be swiveled within a swiveling range and can be rotated with the rotation of the shielding tube 50, so that a large variety of adjustments of the light beam 2 are possible.

In the embodiment of the invention schematically illustrated in FIG. 1, these adjustments can be carried out manually.

Figure 2:
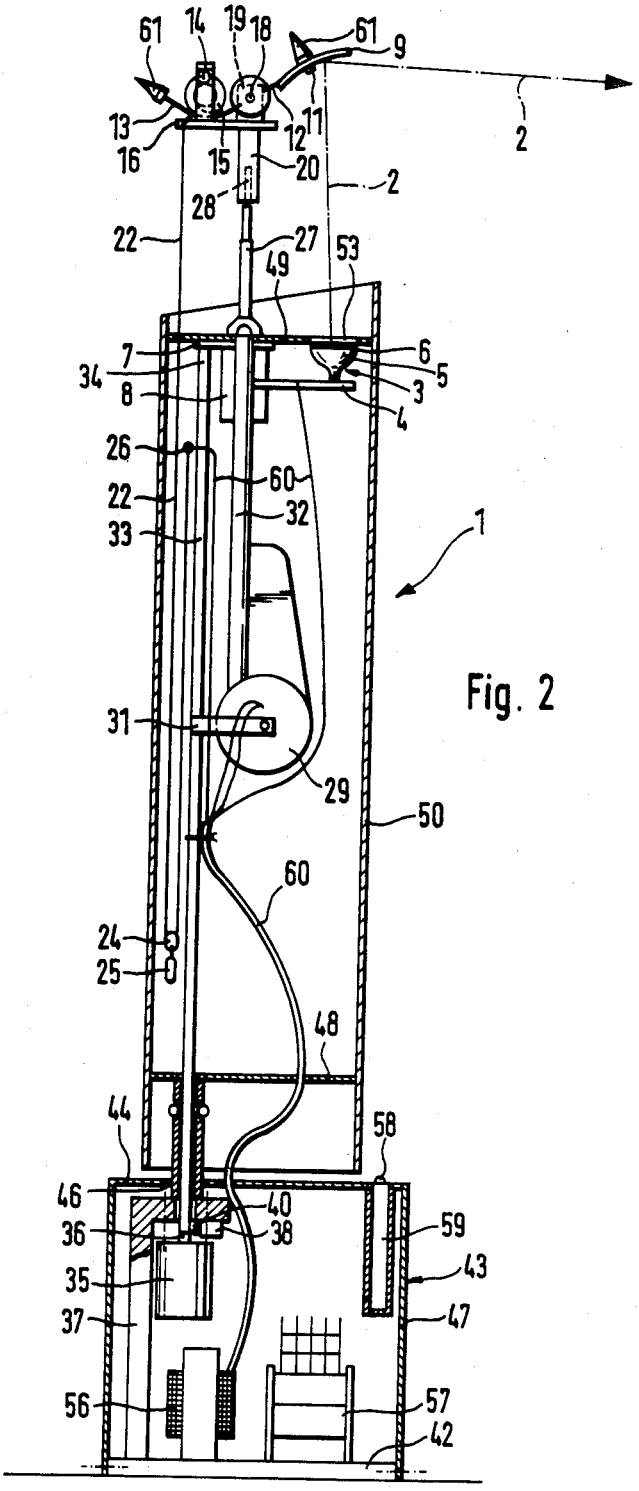
FIG. 2 is a sectional view in longitudinal direction of the projection lamp.

In the projection lamp 1 illustrated in longitudinal section in FIG. 2, the adjustments can be carried out electrically. Light beam 2 is emitted by a projection light 3 which is fastened on a support rod 33 by means of a support member 4, a support piece 8 and a support plate 7. Light 2 has a housing 5 with a rim 6. Rim 6 is arranged underneath an upper cover plate 49.

A guide tube 32 for a telescopically extendable and retractable rod 27 is also attached to support plate 7. In the illustrated embodiment, rod 27 is a component of an extendable member which is connected to a lifting motor 29 underneath guide tube 32. Lifting motor 29 is fastened to support rod 33 by means of a support member 31.

The upper end of guide tube 32 is fastened to and extends upwardly beyond the support plate 7. The upper end extends through one of openings 54 through the upper cover plate 49 and can be fastened at cover plate 49 by means of a cap screw.

Figure 3:
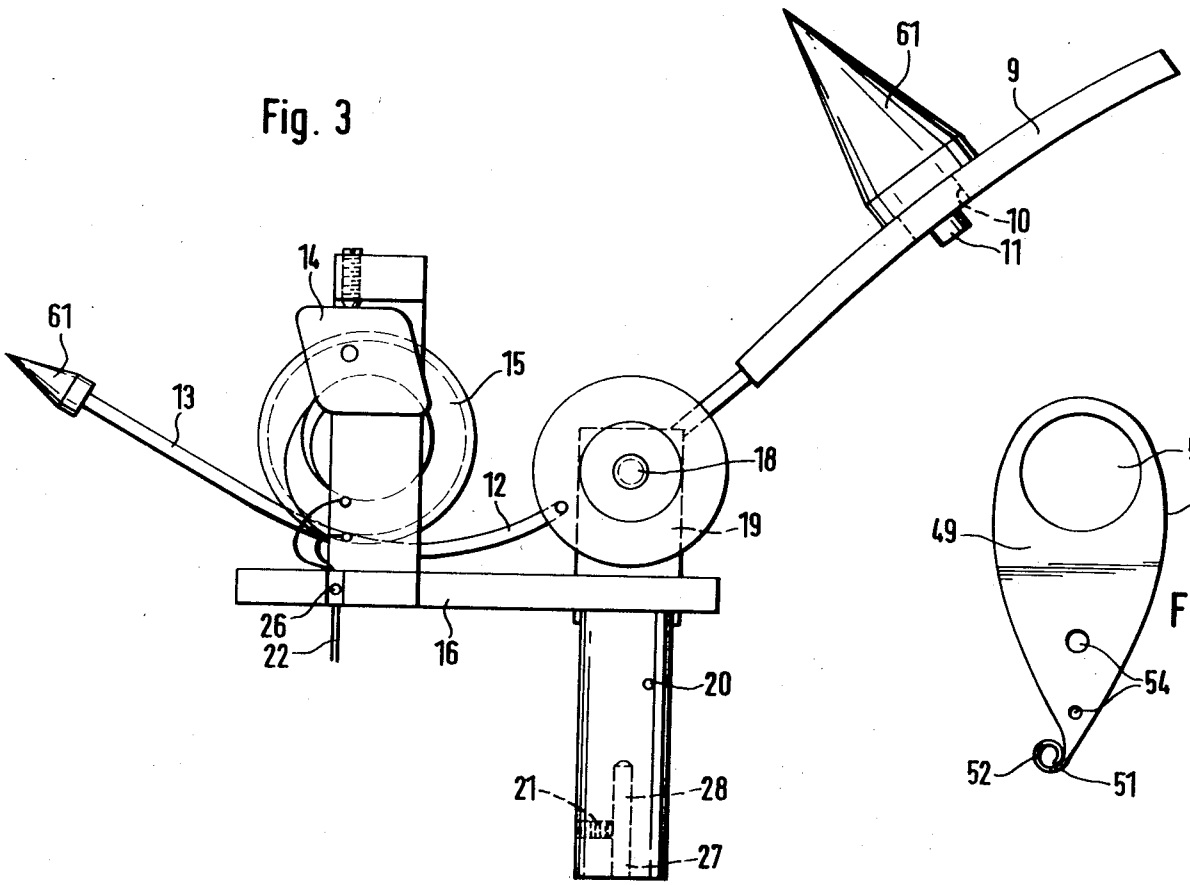
FIG. 3 is a partial sectional view, on a larger scale, of the uppermost portion of the projection lamp.

On the free end 28 of the extendable member 27 is mounted a round rod attachment 20 which supports a plate 16, as illustrated in detail in FIG. 3. Round rod attachment 20 is fastened to the free end 28 of the extendable member 27 by means of a headless screw 21.

On plate 16 is arranged at least one swivel bearing 17 with a swiveling axis 18. A double-arm lever 12 is mounted on axis 18. As seen in FIG. 3, the right end of lever 12 carries mirror 9. Mirror 9 has an opening 10 in which is mounted a pin 11. On the rear side of mirror 9, a cone 61 is attached to pin 11. Pin 11 and cone 61 may be, for example, of fluorescent acrylic glass.

In the illustrated embodiment, a free end 13 of lever 12 has a bent shape and carries an acrylic cone 61. Free end 13 of lever 12 may also be rectilinear. Lever 12 is in operative connection with a swiveling eccentric member 15 which is driven by a swiveling motor 14. The outer edge of eccentric member 15 may have a circumferentially extending groove in which the free end 13 of lever 12 may be guided if this free end has a round cross-section.

Current is supplied to swiveling motor 15 through a hanging line 22. Hanging line 22 is fastened by means of a line fastening member 26 to plate 16.

As FIG. 2 further shows, line 22 is tensioned by means of a roller 24 and a weight 25. Line 22 is connected by means of a line fastening member 26 from which a supply cable 60 extends to the electrical control in the base.

Upper cover plate 49 is attached to the upper end 34 of support rod 33. Support member 31 for the lifting motor 29 is also attached to support rod 33. Support rod 33 is connected to the output shaft 36 of a gear motor 35 which, in turn, is mounted on a stand 37 within base 43. Stand 37 is mounted on a base plate 42. Gear motor 35 includes a swivel limit switch 38 which can be switched from an actuating member 40 which is mounted on support rod 33. As a result, the support rod 33 may be rotatable only about a certain angle, for example, an angle of 360°.

Support rod 33 extends through an opening 46 in cover 44 of base 43. Opening 46 is arranged eccentrically relative to the base. A wall 47 of the base is placed on base plate 42.

In addition to stand 37, within the base are arranged a transformer 56 for the current supply, a rectifier 57 as well as a remote control unit 59 with receiver 58. The switches for the swiveling motor 14, the lifting motor 29 and the gear motor 35 are components of the remote control unit 59. The member light can also be switched on and off by remote control.

Figure 4:
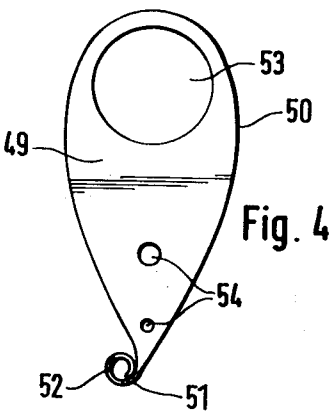
FIG. 4 is a sectional view in transverse direction of the projection lamp.

FIGS. 1, 2 and 4 show that the support rod 33 and the components attached to support rod 33 are surrounded by a shielding tube 50 which is attached to lower plate 48 and upper cover plate 49. The transverse sectional view of FIG. 4 shows this arrangement at the level of plate 49. The upper cover plate 49 and the lower plate 48 may have an oval or drop-like shape. The shielding tube 50 will then have a corresponding shape. Shielding tube 50 is wound around these plates and ends in a rolled-up portion 52 in which the longitudinal edges 51 are connected.

The upper cover plate 49 has an opening 53 for the projection light 3 and openings 54 through which extend the extendable member 27 and hanging line 22 for supplying the swiveling motor 14.

In the illustrated embodiment, only one projection light is shown in combination with a mirror 9.

Without changing the scope of the invention, a plurality of projection lights 3 with corresponding support rods 33 can be combined. The lamp according to the invention may be a floor lamp, a stool lamp, a wall lamp or a ceiling lamp.

While a specific embodiment of the invention has been shown and described in detail to illustrate the application of the inventive principles, it will be understood that the invention may be embodied otherwise without departing from such principles.

I claim:

1. A projection lamp having at least one adjustable light beam, comprising a projection light, a mirror mounted in alignment with and adjustable relative to the projection light, a swivel bearing for swiveling the mirror, a telescopically extendable and retractable rod, the rod having a free end, the swivel bearing being connected to the free end, the telescopically extendable and retractable rod including a base, the projection light including a support member, the base and the support member being connected to a common support rod, the support rod having an upper end, the telescopically extendable and retractable rod being guided in a guide tube, wherein an upper cover plate, a support member for the guide tube and a support member for the projection light are attached to the upper end of the support rod.

2. The lamp according to claim 1, wherein the projection light is mounted in a housing having a rim, the rim being arranged below an opening defined in the upper cover plate.

3. The lamp according to claim 1, wherein the telescopically extendable and retractable rod is actuated by a lifting motor, and wherein the lifting motor is fastened on the support rod as the basis of the telescopically extendable and retractable rod.

4. The lamp according to claim 3, wherein the support rod is attached to a drive shaft of a motor.

5. The lamp according to claim 4, wherein the motor is mounted on a stand with a base, the support rod extending through an eccentrically arranged opening defined in a cover of the base.

6. The lamp according to claim 5, wherein the upper cover plate and another lower plate are arranged eccentrically on the support rod, and wherein a shielding tube is provided which surrounds and extends between the upper cover plate and the lower cover plate.

7. The lamp according to claim 6, wherein the upper cover plate and the lower plate have an oval or drop-like shape, and wherein the shielding tube is of sheet metal having longitudinal ends, the longitudinal ends being wound into a rolled-up portion.

8. The lamp according to claim 7, comprising a rotatably mounted lever for supporting the mirror, a free end of the mirror being in operative connection with an eccentric member driven by a swiveling motor.

9. The lamp according to claim 9, wherein the swivel bearing and the swivel motor are mounted on a plate which is attached by means of a round rod attachment to the free end of the telescopically extendable and retractable rod.

10. The lamp according to claim 9, wherein the mirror defines a central opening, a pin closing the central opening.

11. The lamp according to claim 10, wherein the pin is of fluorescent acrylic glass.

12. The lamp according to claim 5, wherein the circuit of the gear motor includes a swivel limit switch, and wherein the support rod is operatively connected to an actuating member for the swivel limit switch.

13. The lamp according to claim 12, comprising a hanging line for supplying current to the swiveling motor, the hanging line being tensioned by means of roller and a weight.

14. The lamp according to claim 13, wherein switches in the circuits of the gear motors, of the lifting motor, of the swiveling motor and of the projector light are components of a remote control unit mounted in the base.

* * * * *